United States Patent [19]

Albanese

[11] Patent Number: 4,984,367

[45] Date of Patent: Jan. 15, 1991

[54] COMBINATION UTENSIL

[76] Inventor: Joseph Albanese, 102 Village Ave.-Apt. 3C, Rockville Center, N.Y. 11570

[21] Appl. No.: 463,947

[22] Filed: Jan. 8, 1990

Related U.S. Application Data

[63] Continuation of Ser. No. 285,121, Dec. 16, 1988, abandoned.

[51] Int. Cl.[5] ..... A47J 43/28

[52] U.S. Cl. ..... 30/147; 30/322; 30/324

[58] Field of Search ..... 30/147–150, 30/322–328

[56] References Cited

U.S. PATENT DOCUMENTS 843,953 2/1907 Laramy ..... 30/147

2,473,288 6/1949 McNeill ..... 30/147

FOREIGN PATENT DOCUMENTS 2266432 3/1975 France ..... 30/324

*Primary Examiner*—Douglas D. Watts

*Attorney, Agent, or Firm*—Felfe & Lynch

[57] ABSTRACT

A combination utensil is disclosed. The utensil features at least one recess along the back of its handle portion, and a nonlinear end which is received by the user's hand. Both of these features facilitate the utensil's used. Additionally, the other end of the handle portion features a recess adapted for reception of the user's finger. This enables the user to apply pressure to the implement end of the utensil. Placement of this recess on the handle portion and not on the implement portion allows a configuration of the implement portion which includes a concave recess. The utensil may be made, e.g., of biodgradable or recyclable material.

9 Claims, 1 Drawing Sheet

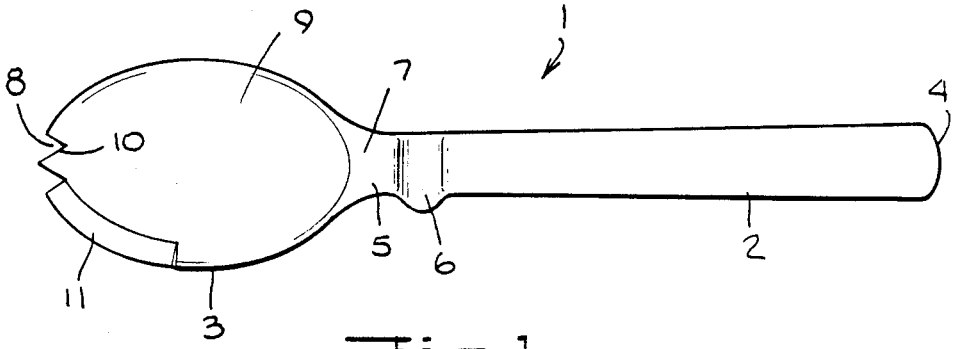
Fig. 1.
Fig. 2.
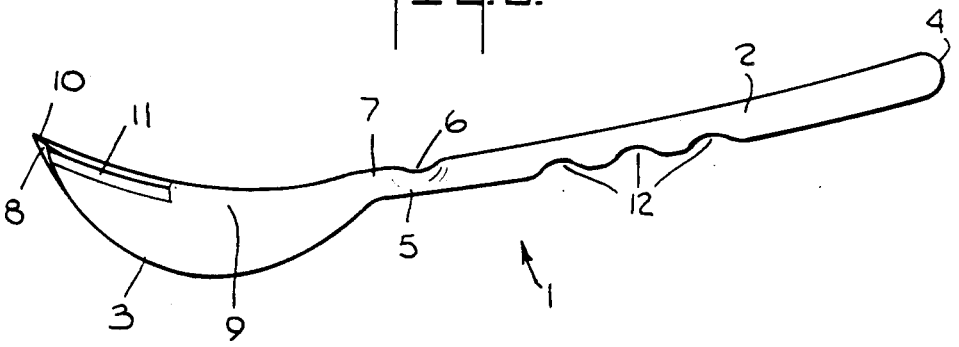

COMBINATION UTENSIL

This application is a continuation of application Ser. No. 285,121, filed Dec. 16, 1988, now abandoned.

FIELD OF THE INVENTION

This invention relates to a combination utensil adapted for ease of use by the user. More particularly, it relates to "one-piece" eating utensils which, if desired, can be recycled or disposed of.

BACKGROUND AND PRIOR ART

Combination utensils used for eating are well known in the art. The term "spork", which refers to the combination of spoon and fork elements being used in the one utensil, is well known even to the very young. Additional devices are also known which incorporate elements of knife and fork, but not spoon (U.S. Pat. No. 4,771,541); or combination of knife, spoon, and fork (D 190,198, D 147,119). These "combination utensils" as they will be described herein, are generally made of disposable material, such as plastic, and are used in cafeterias, prisons, hospitals, and at restaurant type establishments where a great number of meals are served. In a great number of these establishments, the food served is predominantly, or exclusively of the "take-out" variety, and recovery and reuse of the utensils used to consume the food served is not feasible or possible.

The number of such utensils used no doubt has contributed to the number of patents in the field. Thus in U.S. Pat. No. 147,119, which is of course a very early example of the art, one finds the basic combination of a handle, a spoon bowl and a combination of knife edge and fork tines in one apparatus. This is the basic design of all future devices.

As is well recognized, one does not use a spoon, fork, and knife in the same manner. When food is consumed with a fork or spoon, no pressure, or very little pressure need be applied to use the apparatus. When a knife or knife and fork are used, however, it will be appreciated that pressure must be applied to the knife, for cutting, or to the fork holding the foodstuff to be cut. This difference in the way in which the utensils are used means that different considerations and criteria are features of the design and construction of different combination utensils. For example, in a device of the type depicted in D 190,198, where the combination is of a spoon bowl and fork tines, the device is clearly intended to be used for liquids, soft foods, and material which is already in small pieces. Such a device may be constructed of cheap materials as very little pressure need be applied thereto.

When a cutting edge is used in the implement portion of such devices, however, the parameters change, because now the fact that the user must apply pressure comes into consideration. To that end, U.S. Pat. No. 4,771,541 teaches a tab means in the combination knife and fork displayed therein, upon which a user's finger can rest. This tab means permit the user to apply pressure at a point which allows the knife edge to be used, or to hold the fork tines in a piece of food while another cutting edge is used.

The device shown in the '541 patent, however, is not usuable as a spoon means. The tab is positioned on a side of the implement means and such a construction would result in the liquid substance contained, e.g., in a spoon bowl, to pour out.

The art therefore does not teach or suggest a combination utensil which is adapted for each of use, comfort of the user, and must important, permits the combination of availability of a number of cheap materials in its construction together with a spoon bowl means and at least a fork means. It is to a device of this type to which the invention is directed.

SUMMARY OF THE INVENTION

The invention is a combination utensil used in consuming foods and liquids, which is characterized by a handle means and an implement means. The utensil is of a one piece construction, where one end of the handle means joins to the implement means. The handle means has a length defined by two ends, one of which joins the implement means, the other of which is a terminal end. The terminal end is the portion of the device which meets the central portion of the user's hand. As such, in the apparatus described and claimed herein, this terminal end is nonlinear, and may be, e.g., curved, rounded, cylindrical, spherical or some other form which facilitates reception in the hand of the user. At the other end, i.e., the end which joins the implement end, a recessed tab means is provided for reception of the user's finger. This permits the application of pressure on the implement end. The two described ends, of course, define the length of the handle, which also has a front side and a backside. Along the backside of the handle, there are positioned at least one, and preferably more than one, curved recesses. These curved recesses provide several advantages including, but not being limited to, facilitating grip strength, user confort, and so forth. Other advantages arising inherently therefrom will be recognized by the skilled artisan.

The implement means joins the handle means at the non-terminal handle end. The aforementioned tab does not extend into the implement means, which permits the implement means to comprise a concave recess which facilitates reception of a comestible number of tines to produce a fork means. Additionally the implement means may include a cutting edge on one lateral side of the implement means, preferably the side parallel the side containing the tab on the handle means.

Reference is now made to the figures, a description of which follows, and the Detailed Description of Preferred Embodiments, which explains the invention in detail.

BRIEF DESCRIPTION OF THE FIGURES

FIG. 1 is a top view of a preferred embodiment of the apparatus described herein;

FIG. 2 is a side view of this apparatus.

DETAILED DESCRIPTION OF PREFERRED EMBODIMENTS

With reference to the accompanying figures the invention is a combination utensil 1 having a handle portion 2 and an implement portion 3. With reference to the handle portion 2 its length is defined by a first terminal end 4 and a second terminal 5 which leads into, or is connected to the implement portion 3. The first terminal end 4, as will be seen from the drawings is adapted for reception by the user's hand. This first terminal end may be, e.g., rounded, so that there is no discomfort when it is handled.

Positioned at the second terminal end 5 is a recessed tab 6, which tab structure permits positioning of a user's finger thereupon. Such positioning allows the user to apply pressure to the apparatus, e.g., when a cutting edge, which may be serrated, is present and the apparatus is used for slicing or cutting or for applying greater pressure when fork tines are used.

The implement portion is defined by a proximal end 7 and a distail end 8, which define its length. The proximal end 7 defines the start of the implement end. This structure should be distinguished from the second terminal end 5 of the handle portion. The proximal end is characterized by the beginning of the concave recess 9, and as such the recessed tab cannot continue into the implement portion. Proximal end 8 is characterized by a plurality of tines 10, which act as a "fork means".

FIG. 1 shows an optional element of the invention in the longitudinal cutting means 11, positioned on a lateral side of the implement portion and on the side of the utensil opposite the curved recess tab 6.

In FIG. 2, the back of device 1 can be seen, and as such a plurality of recesses 12 may be seen positioned thereon. It is a feature of the invention that at least one, and preferably more of these recesses are present on the back, or dorsal side of the handle portion of the device.

The dimensions of the device may of course vary, but some examples of practical dimensions are a handle length of 3¾", and an implement end length of 2½". The second terminal end of the handle portion, in such a case, can be about ¾" wide, with a rounded first terminal end having dimensions of ¼×¼ inches. The spoon bowl of such a device can be about 1⅛" across, and the tines about ½" long and ¼" apart from each other. When a cutting edge is employed on the lateral side, such is preferably about ¾" long, and may be a straight edge, or may be serrated. The recesses along the back of the handle portion, as shown in FIG. 2, may be placed anywhere along the length desired. Typically, if the handle length is 3¾" and a plurality of recesses is used, these will extend about 1½" along the length of the handle, and be about ¼" apart from each other.

The choice of material used to make the apparatus may vary "Silverware", e.g., is composed of precious or semi-precious metals such as silver, or more "utilitarian" substances such as stainless steel or other metals. When the apparatus is designed for disposal or recycling, the material may be any of the many plastics and moldable substances known to the art for making disposable tableware, as well as cellulose derivatives such as wood, recycled wood, wood pulp and chips, cardboard paper, and so forth. The skilled artisan will be aware of other available materials such as environmentally safe and nontoxic materials, all of which are encompassed by this invention.

It will be understood that the specification and examples are illustrative but not limitative of the present invention and that other embodiments within the spirit and scope of the invention will suggest themselves to those skilled in the art.

I claim:

1. A combination eating utensil comprising:

(i) a handle portion having a frontside and a backside and having a length defined by a first non-linear end and a second end leading into an implement portion, (a) the backside of said handle portion having at least one curved recess along its length, (b) said second end having a tab structure adapted for reception of a user's finger, said tab structure not continuing onto said implement portion;

(ii) an implement portion comprising:

(c) a proximal end connected to said second end of said handle portion;

(d) two opposed lateral sides which define a concave recess which tapers from a widest portion at said proximal end to a narrowest portion at said distal end, said distal end terminating in an alternating series of a plurality of V shaped indentations and V shaped extensions which define a plurality of tines extending directly from said distal end, wherein the number of said indentations is one more than the number of extensions;

(e) two end tines each of which is defined by one of said opposing lateral sides and one side of one of said V shaped indentations; and (f) a single cutting means which extends from one of said two end tines and along a portion of the opposing lateral side defining said end tine, but not along the entire opposing lateral side.

2. Combination utensil of claim 1, wherein said handle means comprises a plurality of curved recesses along its backside length.

3. Combination utensil of claim 1, wherein said cutting edge is serrated.

4. Combination utensil of claim 1, wherein said utensil is comprised of recyclable or reusable material.

5. Combination utensil of claim 4, wherein said recyclable material is a cellulose derived material.

6. Combination utensil of claim 4, wherein said recyclable material comprises wood.

7. Combination utensil of claim 5, wherein said recyclable material comprises a biodegradable plastic.

8. Combination utensil of claim 1, wherein said utensil is comprised of non-toxic material.

9. Combination utensil of claim 1, wherein said utensil is comprised of environmentally safe material.

* * * * *

UNITED STATES PATENT AND TRADEMARK OFFICE

CERTIFICATE OF CORRECTION

PATENT NO. : 4,984,367

DATED : January 15, 1991

INVENTOR(S) : Joseph Albanese

It is certified that error appears in the above-identified patent and that said Letters Patent is hereby corrected as shown below:

Column 4,

Claim 7, line 1: change "5" to -- 4 --.

Signed and Sealed this

First Day of December, 1992

*Attest:*

DOUGLAS B. COMER

*Attesting Officer*

*Acting Commissioner of Patents and Trademarks*